US008057077B2

(12) United States Patent
Gagne et al.

(10) Patent No.: US 8,057,077 B2
(45) Date of Patent: Nov. 15, 2011

(54) SUPPORT DEVICE

(75) Inventors: Jean Gagne, St. Vaudreuil-Dorian (CA); Howard Yaphe, Ville St. Laurent (CA); Andrew Miles, Cornwall (CA)

(73) Assignee: Canlyte Inc., Lachine (CA)

( * ) Notice: Subject to any disclaimer, the term of this patent is extended or adjusted under 35 U.S.C. 154(b) by 1364 days.

(21) Appl. No.: 11/613,632

(22) Filed: Dec. 20, 2006

(65) Prior Publication Data

US 2007/0147053 A1 Jun. 28, 2007

Related U.S. Application Data

(60) Provisional application No. 60/753,504, filed on Dec. 23, 2005.

(51) Int. Cl.
*F21S 8/00* (2006.01)
*F21V 21/00* (2006.01)

(52) U.S. Cl. ..... 362/404; 362/147; 362/391; 362/407

(58) Field of Classification Search ..... 362/147, 362/391, 404, 407
See application file for complete search history.

(56) References Cited

U.S. PATENT DOCUMENTS

| | | | |
|---|---|---|---|
| 200,241 | A | 2/1878 | Atkinson |
| 1,704,990 | A | 3/1929 | Pierce |
| 1,878,084 | A | 9/1932 | Winkler |
| 2,000,241 | A | 5/1935 | Mangin |
| 2,219,383 | A | 10/1940 | Dillon |
| 2,294,883 | A | 9/1942 | Anderson et al. |
| 2,344,935 | A | 3/1944 | Whittaker |
| 2,428,827 | A | 10/1947 | Beck |
| 2,541,828 | A | 2/1951 | Peck |
| 2,640,149 | A | 5/1953 | Arengerg |
| 2,659,807 | A | 11/1953 | Wakefield |
| 2,718,290 | A | 9/1955 | Segil |
| 2,719,374 | A | 10/1955 | Paione |
| 2,736,528 | A | 2/1956 | Le Brock |
| 2,772,742 | A | 12/1956 | Sprankle |
| 2,800,965 | A | 7/1957 | Church |
| 2,817,752 | A | 12/1957 | Florence |
| 2,831,962 | A | 4/1958 | Winkler et al. |
| 2,973,177 | A | 2/1961 | Stubbs |
| 2,982,850 | A | 5/1961 | Lister et al. |
| 2,990,470 | A | 6/1961 | Bodian et al. |
| 3,003,735 | A | 10/1961 | Havener |
| 3,011,047 | A | 11/1961 | Spaulding |
| 3,018,083 | A | 1/1962 | Bobrick |
| 3,019,332 | A | 1/1962 | Schiffer |
| 3,061,258 | A | 10/1962 | Grenier |
| 3,066,903 | A | 12/1962 | Tinnerman |
| 3,066,904 | A | 12/1962 | Cook et al. |
| 3,070,689 | A | 12/1962 | McIntosh |
| 3,118,621 | A | 1/1964 | Bailey |
| 3,155,324 | A | 11/1964 | Chen |

(Continued)

*Primary Examiner* — Jason Moon Han
*Assistant Examiner* — Sean Gramling
(74) *Attorney, Agent, or Firm* — John F. Salazar

(57) ABSTRACT

A support device for supporting a light fixture includes an anchor portion for anchoring the light fixture to a ceiling location, a wing arrangement coupled to the anchor portion, the wing arrangement including a central base portion and a pair of wing portions extending outwardly therefrom, each wing portion including a body having a distal edge region and a proximal flange portion joined to the central base portion, a first passage in each body and a second passage in each proximal flange, the first and second passages to form a path to receive one or more cable members to be suspended therefrom to support a light fixture thereon.

16 Claims, 5 Drawing Sheets

U.S. PATENT DOCUMENTS 3,222,839 A 12/1965 Philpot
3,246,137 A 4/1966 Zagel
3,319,059 A 5/1967 Ogden
3,349,237 A 10/1967 Jackson
3,374,979 A 3/1968 Coldren et al.
3,383,811 A 5/1968 Ades
3,545,145 A 12/1970 Yousefpor
3,589,660 A 6/1971 Dunckel
3,599,921 A 8/1971 Cumber
3,601,862 A 8/1971 Hargadon
3,612,461 A 10/1971 Brown
3,626,176 A 12/1971 Tsugami
3,628,601 A 12/1971 Snaper et al.
3,633,600 A 1/1972 Sadamori
3,652,780 A 3/1972 Wilson
3,668,998 A 6/1972 Johnson et al.
3,687,055 A 8/1972 Dean, Jr. et al.
3,701,895 A 10/1972 Sweetser
3,720,432 A 3/1973 Chudler
3,743,228 A 7/1973 Drab
3,750,136 A 7/1973 Roess
3,780,973 A 12/1973 Dalton, Jr.
3,816,880 A 6/1974 Jacobs
3,843,086 A 10/1974 Ptak
3,883,732 A 5/1975 Peterson et al.
4,048,493 A 9/1977 Lee
4,080,978 A 3/1978 McCabe
4,086,480 A 4/1978 Lahm
4,101,103 A 7/1978 Mooney et al.
4,135,692 A 1/1979 Ferguson
4,149,226 A 4/1979 Dalton
4,158,221 A 6/1979 Agabekov
4,175,281 A 11/1979 Lonseth
RE30,204 E 2/1980 Root
4,191,352 A 3/1980 Schuplin
4,222,641 A 9/1980 Stolov
4,230,297 A 10/1980 Comer et al.
4,240,133 A 12/1980 Haina et al.
4,263,930 A 4/1981 McCabe
4,315,186 A 2/1982 Hirano et al.
4,338,653 A 7/1982 Marrero
4,356,537 A 10/1982 Stahlhut et al.
4,388,642 A 6/1983 Reno, Jr. et al.
4,389,096 A 6/1983 Hori et al.
4,392,187 A 7/1983 Bornhorst
4,396,288 A 8/1983 Helphrey
4,407,011 A 9/1983 Lahm
4,419,717 A 12/1983 Price et al.
4,424,554 A 1/1984 Woloski et al.
4,435,047 A 3/1984 Fergason
4,449,589 A 5/1984 McCoy
4,463,896 A 8/1984 Schaus
4,494,175 A 1/1985 Gawad et al.
4,494,450 A 1/1985 Avril
4,495,549 A 1/1985 Carlson et al.
4,522,541 A 6/1985 Bidwell
4,602,321 A 7/1986 Bornhorst
4,613,207 A 9/1986 Fergason
4,627,498 A 12/1986 Aalto et al.
4,646,212 A 2/1987 Florence
4,705,255 A 11/1987 Reed, Jr.
4,716,504 A 12/1987 Pahl et al.
4,717,993 A 1/1988 Bernhart et al.
4,726,781 A 2/1988 Bernhart et al.
4,803,603 A 2/1989 Carson
4,860,180 A 8/1989 Degelmann
4,866,583 A 9/1989 Targetti
4,933,820 A 6/1990 Engel
4,958,687 A 9/1990 Nakagawa
4,958,792 A 9/1990 Rinderer
4,980,808 A 12/1990 Lilos
5,050,047 A 9/1991 Viner et al.
5,055,985 A 10/1991 Fabbri
5,072,344 A 12/1991 Fabbri
5,171,184 A 12/1992 Saucier et al.
5,221,138 A 6/1993 Bostjancic et al.
5,425,673 A 6/1995 Mahlanen et al.
5,440,469 A * 8/1995 Gomes ..... 362/648
5,479,327 A 12/1995 Chen
5,533,696 A 7/1996 Laughlin et al.
5,658,066 A 8/1997 Hirsch
5,667,181 A 9/1997 Van Leeuwen et al.
6,007,217 A 12/1999 Ferrier
6,155,921 A 12/2000 Evans et al.
6,203,421 B1 3/2001 Black
6,260,810 B1 7/2001 Choi
6,345,800 B1 2/2002 Herst et al.
6,568,830 B2 5/2003 Yaphe et al.
6,634,772 B2 10/2003 Yaphe et al.
6,637,710 B2 10/2003 Yaphe et al.
6,746,325 B2 6/2004 Crane
6,769,784 B2 8/2004 Yaphe et al.
2003/0227776 A1 * 12/2003 Lin ..... 362/402

* cited by examiner

SUPPORT DEVICE

CROSS-REFERENCE TO RELATED APPLICATIONS

The entire subject matter of U.S. Provisional application Ser. No. 60/753,504, filed Dec. 23, 2005 and entitled SUPPORT DEVICE is incorporated by reference. The applicants claim priority benefit under Title 35, United States Code, Section 119 of U.S. Provisional application Ser. No. 60/753,504, filed Dec. 23, 2005 and entitled SUPPORT DEVICE.

STATEMENT REGARDING FEDERALLY SPONSORED RESEARCH OR DEVELOPMENT

Not applicable.

BACKGROUND OF THE INVENTION

1. Field of the Invention

The present invention relates to lighting fixtures.

2. Description of the Related Art

Light fixtures are commonly suspended from ceiling locations. It is often awkward to adjust the position of such light fixtures.

It would be desirable to provide a novel approach to suspending a light fixture.

SUMMARY OF THE INVENTION

In one aspects, there is provided a support device for supporting a light fixture, comprising an anchor portion for anchoring the light fixture to a ceiling location, a wing arrangement coupled to the anchor portion, the wing arrangement including a central base portion and a pair of wing portions extending outwardly therefrom, each wing portion including a body having a distal edge region and a proximal flange portion joined to the central base portion, a first passage in each body and a second passage in each proximal flange, the first and second passages to form a path to receive one or more cable members to be suspended therefrom to support a light fixture thereon. While one or more cable members are described below, other elongate flexible members may also be used, such as ropes, cords, threads, plastic extrusions and the like.

In an alternative embodiment, the anchor portion includes an anchor fastener to extend downwardly from the ceiling location, the central base portion including a central third passage to receive the anchor fastener therethrough, the wing portions having opposite longitudinal edge regions, each of the second passages being open to a corresponding longitudinal edge region.

In an alternative embodiment, the cable path is arranged to extend around the central third passage.

An alternative embodiment further comprises a cover plate mounted to the wing arrangement, the cover plate having a pair of fourth passages, each to be aligned with a corresponding first passage.

In an alternative embodiment, each distal edge region includes a remote first flange portion, the cover plate having a peripheral second flange portion to be positioned adjacent the first flange portion.

In an alternative embodiment, each body has an opening adjacent the first flange portion.

In an alternative embodiment, the cover plate includes a central fifth passage to receive the anchor fastener.

In an alternative embodiment, the anchor member includes a suspension bracket for use on a T-shaped runner.

An alternative embodiment further comprises one or more cable members being to extend along the path defined by the two first passages and the two second passages from one wing portion to another In an alternative embodiment, the cable has a first cable end region for anchoring to the light fixture and a second cable end region for removable attachment to the light fixture.

In an alternative embodiment, the second cable end region is removably attached to a releasable cable coupling unit.

In an alternative embodiment, the cover plate includes a sixth passage and a conduit portion extending through the sixth passage.

In another alternative aspect, there is provided a light fixture installation, comprising a support device and a light fixture, the support device including an anchor portion for anchoring the light fixture to a ceiling location, a wing arrangement coupled to the anchor portion, the wing arrangement including a central base portion and a pair of wing portions extending outwardly therefrom, each wing portion including a body having a distal edge region and a proximal flange portion joined to the central base portion, a first passage in each body and a second passage in each proximal flange portion, the first and second passages forming a cable path, one or more cables extending along the cable path, the one or more cables having free end regions coupled to the light fixture for suspending the light fixture.

In another alternative aspect, there is provided a method of installing a light fixture, comprising:

- providing a support device with an anchor portion for anchoring the light fixture to a ceiling location;
- coupling a wing arrangement to the anchor portion, the wing arrangement including a central base portion and a pair of wing portions extending outwardly therefrom, each wing portion including a body having a distal edge region and a proximal flange portion joined to the central base portion, a first passage in each body and a second passage in each proximal flange portion;
- forming a cable path extending through the first and second passages;
- feeding one or more cables along the cable path, so that the one or more cables having free end regions hanging below the support device;
- coupling the free end regions to the light fixture for suspending the light fixture;
- adjusting the orientation of the light fixture by adjusting relative positions of the free end regions.

In yet another alternative aspect there is provided a method of installing a light fixture, comprising:

- a step for providing a support device with an anchor portion for anchoring the light fixture to a ceiling location;
- a step for providing a wing arrangement coupled to the anchor portion, the wing arrangement including a central base portion and a pair of wing portions extending outwardly therefrom, each wing portion including a body having a distal edge region and a proximal flange portion joined to the central base portion, a first passage in each body and a second passage in each proximal flange portion;
- a step for forming a cable path extending through the first and second passages;
- a step for feeding one or more cables along the cable path, so that the one or more cables having free end regions hanging below the support device;
- a step for coupling the free end regions to the light fixture for suspending the light fixture; and a step for adjusting the orientation of the light fixture by adjusting relative positions of the free end regions.

In still another alternative aspect, there is provided a support device for supporting a light fixture, comprising anchor means for anchoring the light fixture to a ceiling location, wing means coupled to the anchor means, the wing means including a central base means and a pair of wing portions extending outwardly therefrom, each wing portion including a body having a distal edge region and a proximal flange portion joined to the central base portion, a first passage in each body and a second passage in each proximal flange portion, the first and second passages to form a path to receive one or more suspension means to be suspended therefrom to support a light fixture thereon.

An alternative embodiment provides a pair of cable portions, each being arranged to extend between the light fixture and the wing arrangement.

In an alternative embodiment, each cable portion is removably anchored at the light fixture and the wing arrangement.

BRIEF DESCRIPTION OF THE DRAWINGS

Several preferred embodiments of the present invention will now be described, by way of example only, with reference to the appended drawings in which.

DESCRIPTION OF THE PREFERRED EMBODIMENTS

Figure 1:
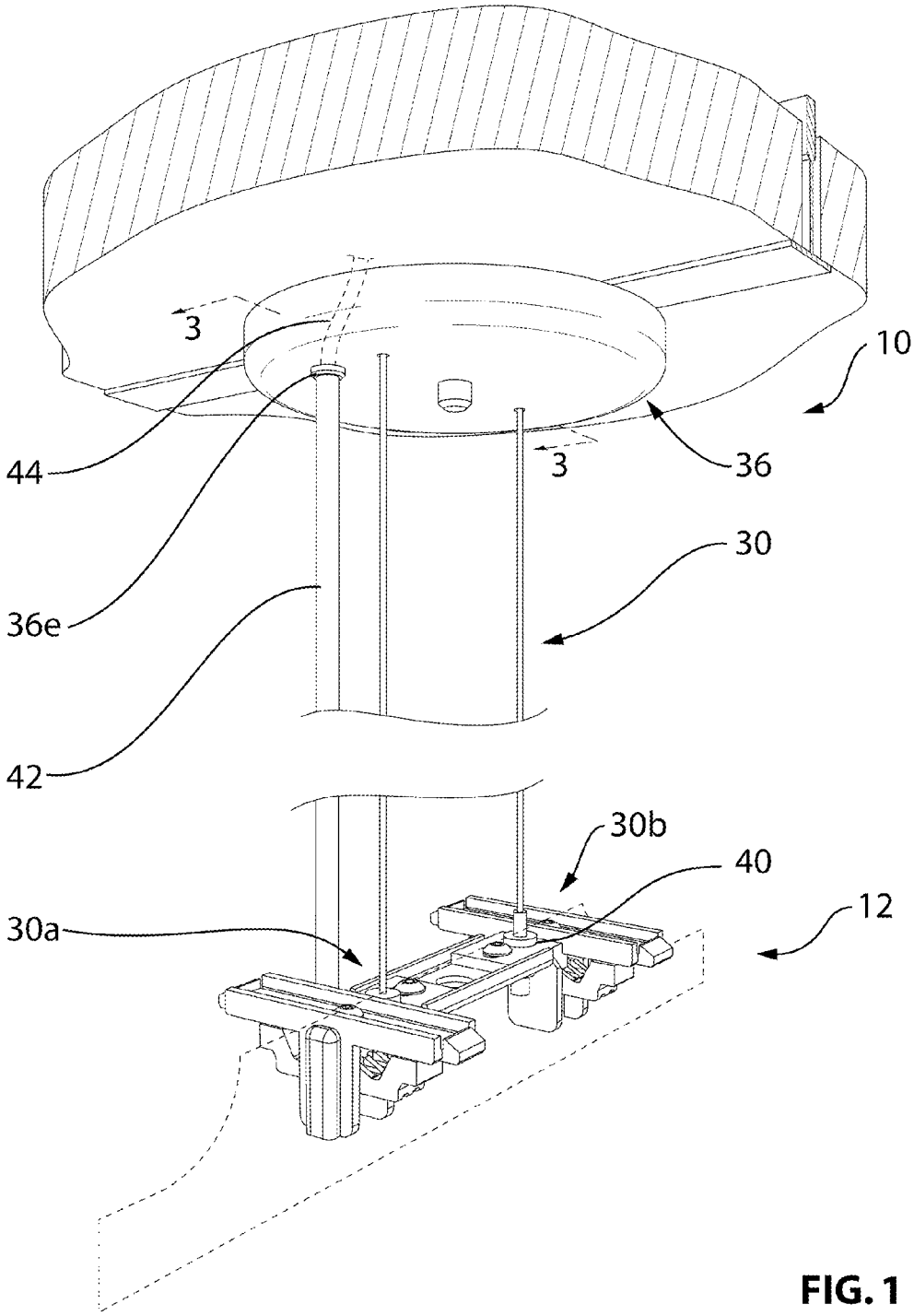
FIG. 1 is fragmentary perspective view of a light fixture installation.

Referring to the figures, there is provided a support device 10 for supporting a light fixture, a part of which is shown at 12. The support device 10 has an anchor portion 14 for anchoring the light fixture 12 to a ceiling location 16. In this case, the ceiling location 16 is a T-bar section which is part of a suspended ceiling structure. However, other ceiling structures may also be used in other examples, such as those which utilize junction boxes and the like. A wing arrangement 18 is coupled to the anchor portion 14. In this case, the wing arrangement 18 includes a central base portion 20 and a pair of wing portions 22, 24 extend outwardly therefrom.

Each wing portion 22, 24 includes a body 22*a*, 24*a* having a distal edge region 22*b*, 24*b* and a proximal flange portion 22*c*, 24*c* joined to the central base portion 20. A first passage 22*d*, 24*d* is provided in each body and a second passage 22*e*, 24*e* is provided in each proximal flange portion 22*c*, 24*c*. The first and second passages 22*d*, 24*d*, 22*e*, 24*e* form a path to receive one or more cable members (in this case a single cable member 30) to be suspended from the support device 10 to support the light fixture 12 thereon. While one or more cable members are described below, other elongate flexible members may also be used, such as ropes, cords, threads, plastic extrusions and the like. For example, a pair of separate cables may be provided, each to pass through and be held in a corresponding first passage 22*d*, 24*d* without requiring the second passages 22*e*, 24*e*.

The anchor portion 14 includes an anchor fastener 14*a* to extend downwardly from the ceiling location 16. In this example, the central base portion 20 includes a central third passage 20*a* (FIG. 3) to receive the anchor fastener 14*a* therethrough. The central base portion 20 is thus secured to the anchor portion 14 by way of threaded fastener 26.

Figure 5:
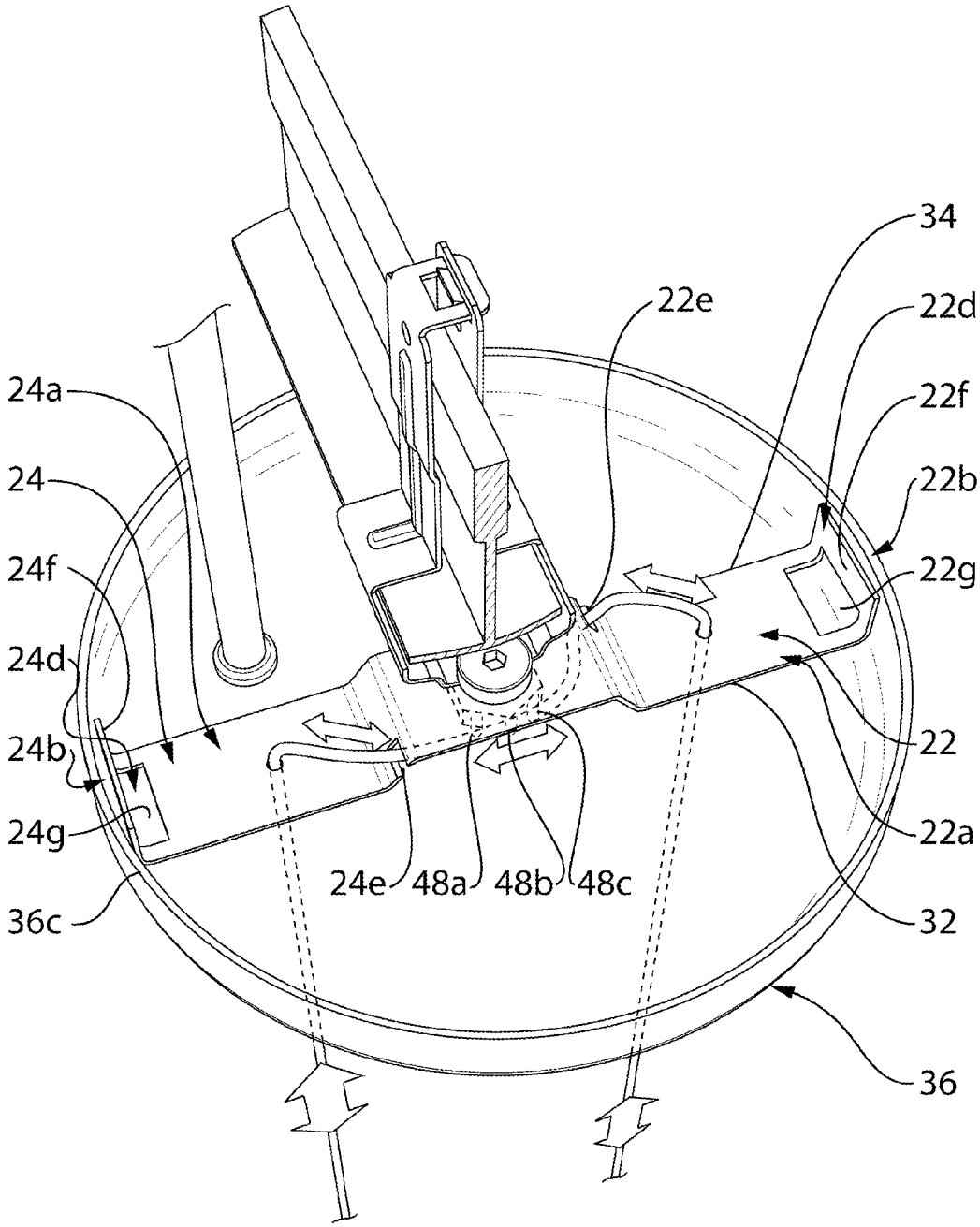
FIG. 5 is another fragmentary perspective view of the installation of FIG. 1.

As best seen in FIG. 5, the wing portions 22, 24 have common opposite longitudinal edge regions 32, 34. Each of the second passages 22*e*, 24*e* is open to a corresponding longitudinal edge region, each to form an open notch. However, the second passages 22*e*, 24*e* may, if desired, be formed as holes rather than as notches, if desired, that is in the same way as the first passages 22*d*, 24*d*. Alternatively, the wing portions 22, 24 may be formed differently in the region of the proximal flange portion to allow for the passage of the cable therethrough while not necessarily forming a notch or an opening. For instance, each proximal flange portion may be shaped to lie adjacent the path and be provided with a clamp, brace or guide portion to guide and/or confine the cable to the path.

Thus, it can be seen that the cable path is arranged to extend around the central third passage 20*a* (FIG. 3) and thus the anchor fastener 14*a*.

Figure 2:
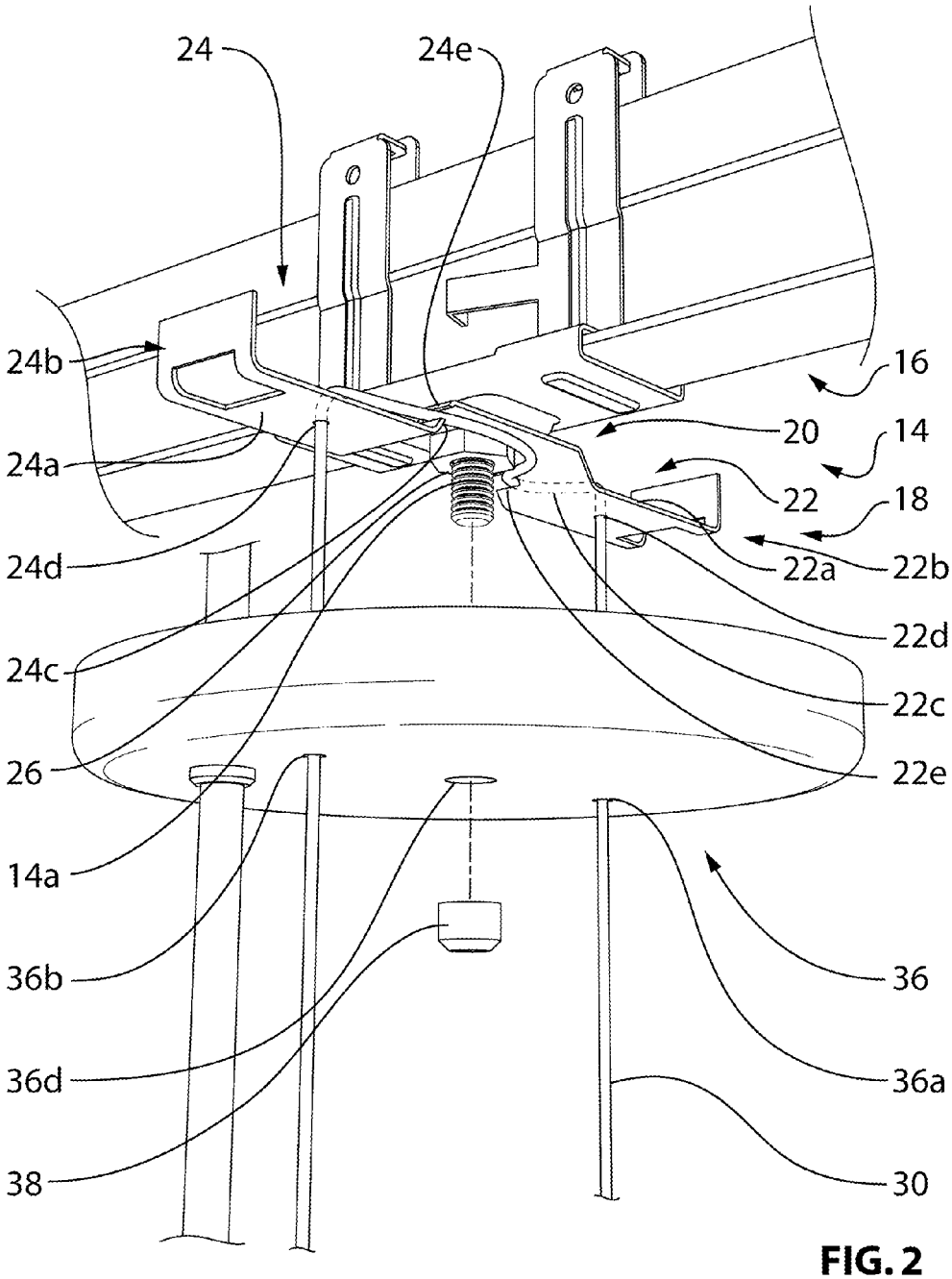
FIG. 2 is a fragmentary perspective view of a portion of the installation of FIG. 1.

Referring to FIG. 2, a cover plate 36 is provided for mounting to the wing arrangement 18. The cover plate 36 has a pair of fourth passages 36*a*, 36*b*, each of which is aligned with a corresponding first passage 22*d*, 24*d*.

As best seen in FIG. 5, it can be seen that each distal edge region 22*b*, 24*b* of each body 22*a*, 24*a* includes a remote first flange portion 22*f*, 24*f* and the cover plate 36 has a peripheral second flange portion 36*c* to be positioned adjacent the first flange portions.

Each body 22*a*, 24*a* also has an opening 22*g*, 24*g* adjacent the first flange portion. Referring to FIG. 2, the cover plate 36 also has a central fifth passage 36*d* to receive the anchor fastener 14*a*. In this case, a fastener in the form of a threaded or non-threaded cap member 38 is engageable with the anchor fastener 14*a* to secure the cover plate 36 in position.

A number of different anchor portions 14 may be used in connection with the support device. In this case, the anchor portion 14 includes a suspension bracket for use on a T-shaped runner. Earlier versions of this suspension bracket are shown in U.S. Pat. No. 6,637,710, granted Oct. 28, 2003, entitled FIXTURE SUSPENSION BRACKET ASSEMBLY, the entire subject matter of which is incorporated herein by reference.

One or more cable members, in this case one cable member 30, extends along the path defined by the first and second passages 22*d*, 24*d*, 22*e*, 24*e* from one wing portion to another. Referring to FIG. 1, the cable member 30 has a first cable end region 30*a* for anchoring to a light fixture 12 and a second cable end region 30*b* for removable attachment to the light fixture 12. The second cable end region 30*b* is, in this example, removably and/or releasably attached to a releasable cable coupling unit 40, such as that available under the trade name GRIPLOCK.

It can be seen that the cover plate 36 includes a sixth passage 36*e* to receive a conduit portion 42, for housing or channeling electrical and/or communication cables, shown schematically at 44, between the light fixture 12 and a central power supply and/or communications hub, not shown.

Thus, the support device 10 provides a method of installing a light fixture 12 that allows for convenient adjustments of the light fixture 12. First, the support device 10 is provided with the anchor portion 14 which is arranged for anchoring to a ceiling location. The wing arrangement 18 may then be coupled to the anchor portion 14. This is done by orienting the wing arrangement 18 so that the anchor fastener 14*a* is extended through the central third passage 20*a* and by securing the wing arrangement in place by way of fastener 26.

The cable member 30 is then fed through the first and second passages and around the anchor fastener 14*a* along the path and the first and second cable end regions 30*a*, 30*b* are left to hang below the wing arrangement 18. The first and second cable end regions are then fed through the corresponding fourth passages 36*a* and 36*b* in the cover plate. The cover plate 36 is then placed with the anchor fastener 14 extending through the central fifth passage 36*d*. The cover plate is then held in position with the cap member 38 threadably or frictionally engaged with the anchor fastener 14*a*. Of course, the cover plate 36 may be secured in place using other fastening products and techniques, such as by adhesives, hook and loop fasteners and the like. This brings the fourth passages 36*a*, 36*b* into line with the corresponding first passages 22*d*, 24*d* and the second peripheral flange 36*c* into proximity with the remote first flange members 22*f*, 24*f*.

Figure 4:
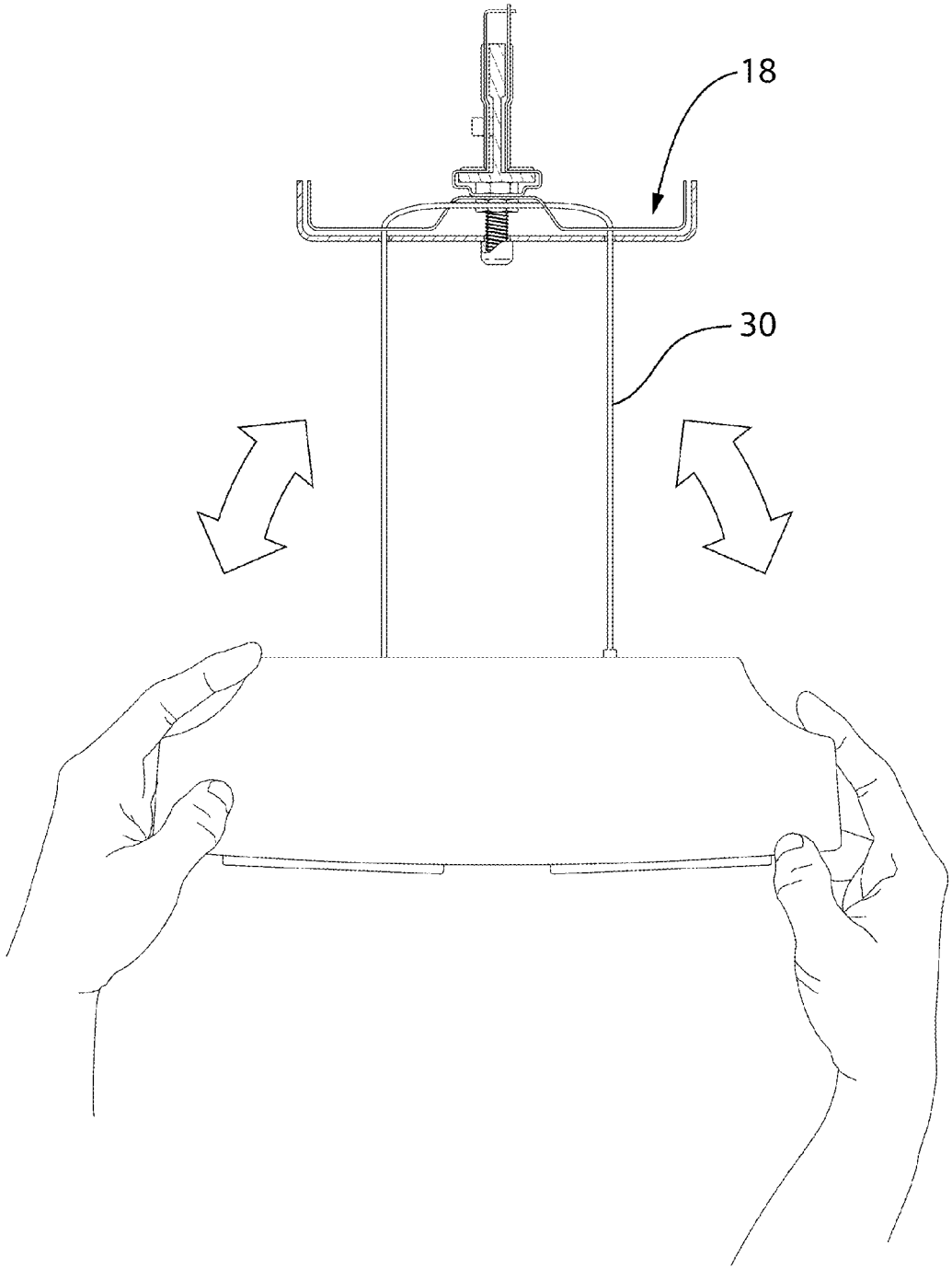
FIG. 4 is an operational sectional view according to FIG. 3.

The first cable end region 30*a* is then fixed to the light fixture 12 and the second cable end region 30*b* is provided with the releasable cable coupling unit 40. This allows the second cable end region 30*b* to be adjustable in the releasable cable coupling unit 40, so that the effective length of the cable member 38 may be lengthened or shortened by corresponding adjustments of the relative position of the cable member 38 in the releasable cable coupling unit 40. The releasable cable coupling unit 40 may then be attached to the light fixture 12 so that the latter is now suspended from the wing arrangement 18 as shown in FIG. 1 and 4. A user may then adjust the orientation of the light fixture 12 by applying forces to the cable member 30 so that the cable member 30 can be shifted in its position in the wing arrangement 18. For instance, if the user determines that the right hand side of the light fixture 12 is below the left hand side so that the light fixture 12 is not horizontal, the user may then apply a downward force on the left hand side of the light fixture 12, in effect to lengthen the effective cable member between the wing arrangement 18 and the first cable end portion 30*a* and to shorten the effective cable member between the wing arrangement 18 and the second cable end portion 30*b*. By this arrangement, the cable member 38 is able to slide along the path and is not pinched or otherwise unduly impeded by the structure of the wing arrangement 18, the anchor fastener, nor the various passages through which the cable.

Figure 3:
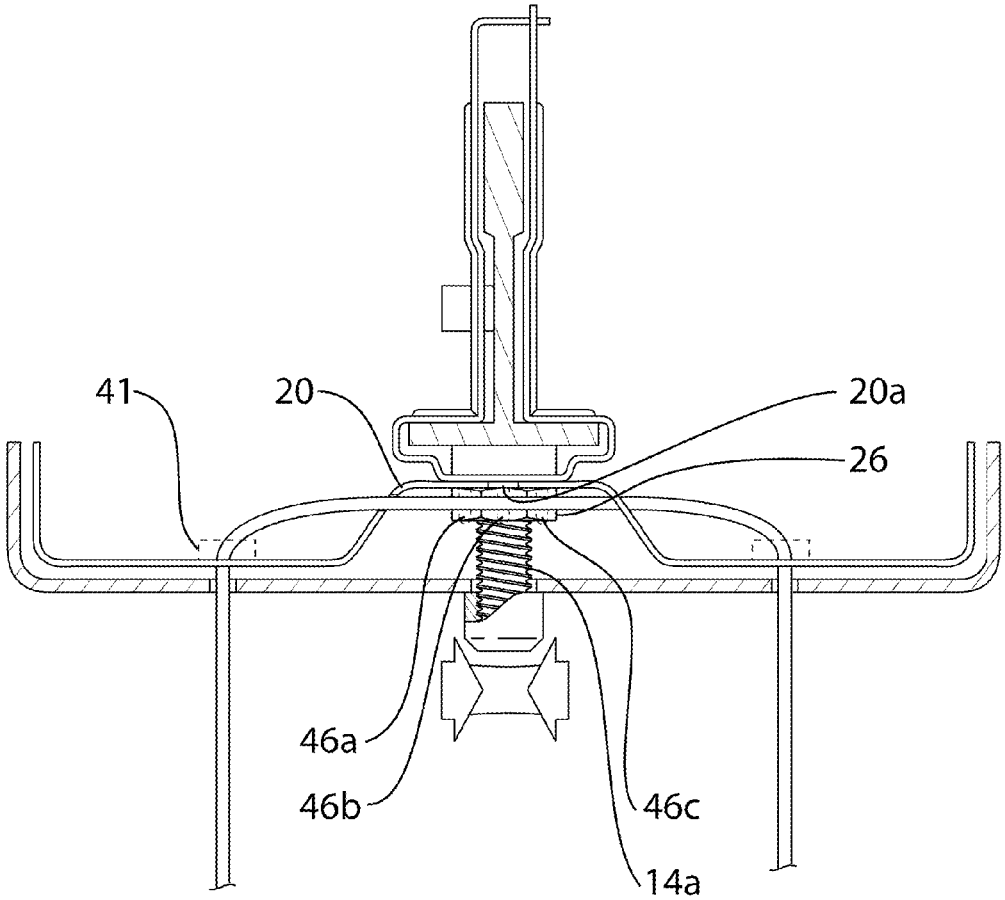
FIG. 3 is a sectional view taken on line 3-3 of FIG. 1.

If desired, one or more guide portions, as shown in dashed lines in FIG. 3 at 46*a*, 46*b* and 46*c* may be provided to guide the cable around the anchor fastener 14*a* and threaded fastener 26. This may be desirable in some cases to allow the cable to feed along the cable path without engaging the anchor fastener 14*a* or threaded fastener 26. Other guide portions may also be provided as desired further to define the cable path. Among other fabrication techniques, the guide portions 46*a*, 46*b* and 46*c* may, for example, be formed by first providing three flanges, as shown in dashed lines at 48*a*, 48*b* and 48*c* in FIG. 5, in a punch step or other fabrication step in the central base portion 20, and then by bending the flanges to extend downwardly from the central base portion. Alternatively, the guide portions may be formed on one or more than one separate article which may then be attached to the central base portion 20 or in the vicinity thereof.

While the cable path is arranged to extend around the central third passage for the support device 10, there may be other arrangements in which the wing arrangement is secured to the anchor portion without need for the anchor fastener 14*a* or the central third passage 20*a*. For example, the anchor fastener may in fact be secured to the central base portion to extend through a corresponding passage in an anchor portion secured to the ceiling location. An example may be a passage in a T-bar section, for instance. In this case, the anchor fastener may not project into a region between the two second passages, meaning that the path need not extend around the anchor fastener in this case. In yet another example, the anchor fastener 14*a* may be shorter in length, still allowing the anchor fastener 14*a* to pass through the central third passage 20*a* in the central base portion 20 and be secured thereto by way of the threaded fastener 26 without the anchor fastener or threaded fastener obstructing the region between the two second passages.

In another alternative example, the cable member 38 may be replaced by a pair of cable portions, each of which is arranged to extend between the light fixture and the wing arrangement. Furthermore, each cable portion may be independently removably anchored at the light fixture (as for example by way of a releasable coupling unit as shown at 40 in FIG. 1) and at the wing arrangement, by way of an anchor portion, such as that shown schematically in dashed lines at 41 in FIG. 3. Thus, in this example, adjustment of the light fixture may be achieved by adjusting the position of the cable portion in the releasable coupling unit or at the anchor portion, if desired.

While the present invention has been described for what are presently considered the preferred embodiments, the invention is not so limited. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

The invention claimed is:

1. A support device for supporting a light fixture, comprising an anchor portion for anchoring the light fixture to a ceiling location, a wing arrangement coupled to the anchor portion, the wing arrangement including a central base portion and a pair of wing portions extending outwardly therefrom, each wing portion including a body having a distal edge region and a proximal flange portion joined to the central base portion, a first passage in each body and a second passage in each proximal flange, the first and second passages to form a cable path to receive one or more cable members to be suspended therefrom, the one or more cable members supporting the light fixture, and a cover plate mounted to the wing arrangement, the cover plate having a pair of third passages, each third passage receiving the one or more cable members.

2. A device as defined in claim 1, the anchor portion including an anchor fastener to extend downwardly from the ceiling location, the central base portion including a central fourth passage to receive the anchor fastener therethrough, the wing portions having opposite longitudinal edge regions, each of the second passages being open to a corresponding longitudinal edge region.

3. A device as defined in claim 2, the cable path being arranged to extend around the central fourth passage.

4. A device as defined in claim 1, each distal edge region including a remote first flange portion, the cover plate having a peripheral second flange portion to be positioned adjacent the first flange portion.

5. A device as defined in claim 4, each body having an opening adjacent the first flange portion.

6. A device as defined in claim 1, the cover plate including a central fifth passage to receive the anchor fastener.

7. A device as defined in claim 6, wherein the anchor member includes a suspension bracket for use on a T-shaped runner.

8. A device as defined in claim 1, further comprising one or more cable members being arranged to extend along the path defined by the two first passages and the two second passages from one wing portion to another.

9. A device as defined in claim 8, the cable having a first cable end region for anchoring to the light fixture and a second cable end region for removable attachment to the light fixture or to the wing arrangement.

10. A device as defined in claim 9, the second cable end region being removably attached to a releasable cable coupling unit.

11. A device as defined in claim 10, the cover plate including a sixth passage and a conduit portion extending through the sixth passage.

12. A device as defined in claim 1, wherein said one or more cable members comprises a pair of separate portions, each being arranged to extend between the light fixture and the wing arrangement.

13. A device as defined in claim 12, each cable portion being removably anchored at the light fixture and the wing arrangement.

14. A light fixture installation, comprising a support device and a light fixture, the support device including an anchor portion for anchoring the light fixture to a ceiling location, a wing arrangement coupled to the anchor portion, the wing arrangement including a central base portion and a pair of wing portions extending outwardly therefrom, each wing portion including a body having a distal edge region and a proximal flange portion joined to the central base portion, a first passage in each body and a second passage in each proximal flange portion, the first and second passages forming a cable path, one or more cables extending along the cable path, the one or more cables having free end regions coupled to the light fixture for suspending the light fixture, and a cover plate mounted to the wing arrangement, the cover plate having a pair of third passages, each third passage receiving the one or more cables.

15. A method of installing a light fixture, comprising:

providing a support device with an anchor portion for anchoring the light fixture to a ceiling location;

coupling a wing arrangement to the anchor portion, the wing arrangement including a central base portion and a pair of wing portions extending outwardly therefrom, each wing portion including a body having a distal edge region and a proximal flange portion joined to the central base portion, a first passage in each body and a second passage in each proximal flange portion;

forming a cable path extending through the first and second passages;

feeding one or more cables along the cable path, so that the one or more cables having free end regions hanging below the support device;

coupling the free end regions to the light fixture for suspending the light fixture; and adjusting the orientation of the light fixture by adjusting relative positions of the free end regions; and mounting a cover plate to the wing arrangement, the cover plate having a pair of third passages, each third passage receiving the one or more cables.

16. A support device for supporting a light fixture, comprising anchor means for anchoring the light fixture to a ceiling location, wing means coupled to the anchor means, the wing means including a central base means and a pair of wing portions extending outwardly therefrom, each wing portion including a body having a distal edge region and a proximal flange portion joined to the central base portion, a first passage in each body and a second passage in each proximal flange portion, the first and second passages to form a path to receive one or more suspension means to be suspended therefrom, the one or more suspension means supporting the light fixture, and a cover plate mounted to the wing means, the cover plate having a pair of third passages, each third passage receiving the one or more suspension means.

* * * * *